US005854568A

United States Patent [19]

Moscaluk

[11] Patent Number: 5,854,568

[45] Date of Patent: Dec. 29, 1998

[54] VOLTAGE BOOST CIRCUIT AND OPERATION THEREOF AT LOW POWER SUPPLY VOLTAGES

[75] Inventor: Gary Peter Moscaluk, Colorado Springs, Colo.

[73] Assignee: Ramtron International Corporation, Colorado Springs, Colo.

[21] Appl. No.: 915,054

[22] Filed: Aug. 20, 1997

[51] Int. Cl.[6] ..... G05F 1/10

[52] U.S. Cl. ..... 327/537; 327/535; 327/540

[58] Field of Search ..... 323/311, 312, 323/313; 327/530, 534, 535, 537, 538, 540, 541, 543, 545, 546

[56] References Cited

U.S. PATENT DOCUMENTS 5,406,135 4/1995 Kasai et al. ..... 327/108

*Primary Examiner*—Timothy P. Callahan
*Assistant Examiner*—Jeffrey Zweizig
*Attorney, Agent, or Firm*—Peter J. Meza, Esq.

[57] ABSTRACT

A voltage boost circuit allows a reference input voltage to be boosted in a manner that is less sensitive to variations in power supply voltage levels, temperature, and semiconductor process used. A nominal boost voltage of approximately 1.5 volts is supplied, even at very low power supply voltages. A boost voltage less than 1.5 volts is supplied down to power supply voltages of approximately 1.8 volts.

20 Claims, 4 Drawing Sheets

VOLTAGE BOOST CIRCUIT AND OPERATION THEREOF AT LOW POWER SUPPLY VOLTAGES

BACKGROUND OF THE INVENTION

This invention relates generally to integrated circuits. More particularly, the present invention relates to a voltage boost circuit for an integrated circuit.

Boost circuits can be used when a certain voltage on an integrated circuit is too low for a specific application and a higher voltage is needed to obtain a desired function. For example, for increased circuit speed an N-channel MOS transistor requires a higher gate-to-source voltage in order to provide a higher drain-to-source current and thus the faster output response. If the gate-to-source voltage is too low, especially at low power supply voltages, the drain-to-source current generated when the transistor is turned on is very low, contributing to slow response times. Furthermore, variations in semiconductor processes and temperature can also adversely affect circuit performance, compounding the effect.

What is desired, therefore, is a voltage boost circuit that will provide the required boost voltage despite variations in supply voltage, temperature and semiconductor process variations.

SUMMARY OF THE INVENTION

It is, therefore, a principal object of the present invention to generate a boost voltage for certain applications in an integrated circuit that can be maintained at low power supply voltages.

According to the present invention, a voltage boost circuit allows a reference input voltage to be boosted in a manner that is less sensitive to variations in power supply voltage levels, temperature, and semiconductor process used. A nominal boost voltage of approximately 1.5 volts is supplied, even at very low power supply voltages. A boost voltage less than 1.5 volts is supplied down to power supply voltages of approximately 1.8 volts.

In a preferred embodiment, the voltage boost circuit includes a first input for receiving a voltage input signal, a second input for receiving a control signal, an output for providing a boosted input signal, a first transistor having its source/drains coupled between the second input and the output, a second transistor having a gate coupled to the first input and its source/drains coupled between the gate of the first transistor and the output, a third transistor gate coupled to the gate of the first transistor, and source/drains coupled between the output and ground, and a fourth transistor having a gate coupled to the first input and its source/drains coupled between the gate of the first transistor and ground.

Two alternative embodiments of the voltage boost circuit eliminate one of the inputs at the price of increased power dissipation and transistor count.

The foregoing and other objects, features and advantages of the invention will become more readily apparent from the following detailed description of a preferred embodiment of the invention which proceeds with reference to the accompanying drawings.

BRIEF DESCIRIPTION OF THE DRAWINGS

DETAILED DESCRIPTION

Figure 1:
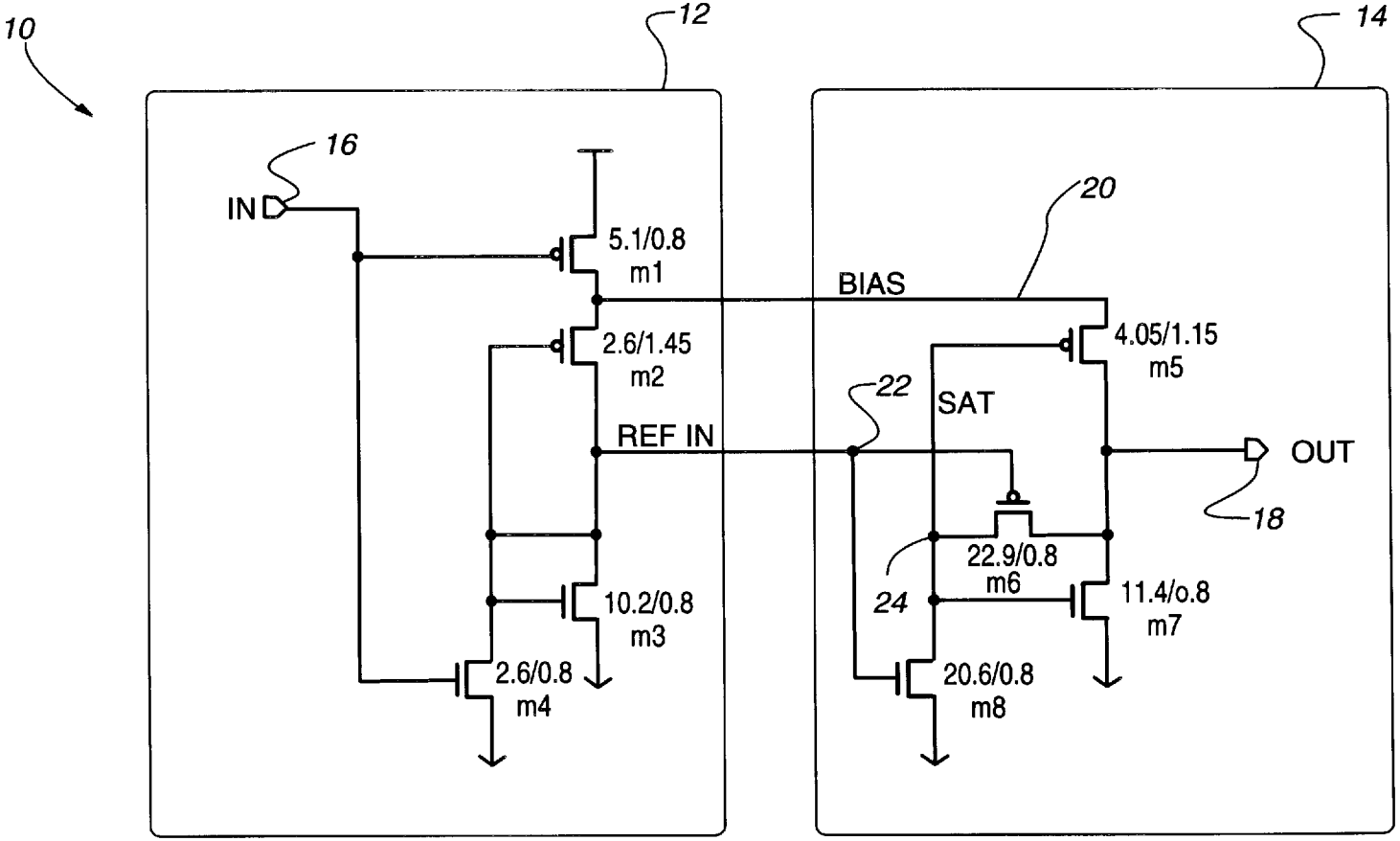
FIG. 1 is a schematic diagram of a first embodiment of a boost circuit according to the present invention, as well as a signal generator circuit.

Referring now to FIG. 1, circuit 10 includes a reference and bias signal generator 12 and a voltage boost circuit 14. Signal generator 12 can be used to generate the necessary signals for boost circuit 14, although other signal generator circuits can be used. Signal generator 12 has an input for receiving the IN signal at node 16, a first output 20 for generating a BIAS control signal and a second output 22 for generating a REFIN signal at node 22. The REFIN signal is at least 0.8 volts and is the signal that is boosted by boost circuit 14. Ideally, the IN, BIAS, and REFIN signals are either pulsed or stepped signals as will be described in further detail below.

Voltage boost circuit 14 includes a first input at node 22 for receiving the REFIN voltage input, a second input at node 20 for receiving the BIAS control signal, and an output at node 18 for providing the OUT signal, which is the voltage-boosted input signal. A first transistor (M5) has a gate (control node), and a source and drain (current path) respectively coupled between the second input at node 20 and the output at node 18. A second transistor (M6) has a gate coupled to the first input at node 22, and source/drains coupled between the gate of transistor M5 (also designated as the SAT signal on node 24) and the output at node 18. A third transistor (M7) has a gate coupled to the gate of transistor M5 at node 24, and a drain and source respectively coupled between the output at node 18 and ground. A fourth transistor has a gate coupled to the first input at node 22 and a drain and source respectively coupled node 24 and ground. The first and second transistors are each P-channel MOS transistors, and the third and fourth transistors are each N-channel MOS transistors.

The sizes of the transistors in the preferred embodiment are as follows:

| Transistor | Length in Microns | Width in Microns |
|---|---|---|
| M5 | 4.05 | 1.15 |
| M6 | 22.9 | 0.8 |
| M7 | 11.4 | 0.8 |
| M8 | 20.6 | 0.8 |

It will be appreciated by those skilled in the art that the transistors sized set forth above are based on a given semiconductor process and can be changed as desired for compatibility with other semiconductor processes. The size of the second and fourth transistors (M6 and M8) is ideally made substantially equal for a nominal boost of about 1.5 volts. For a greater boost voltage, the size of transistor M6 can be made smaller in relation to the size of transistor M8. For a smaller boost voltage, the size of transistor M6 can be made larger in relation to the size of transistor M8.

Figure 2:
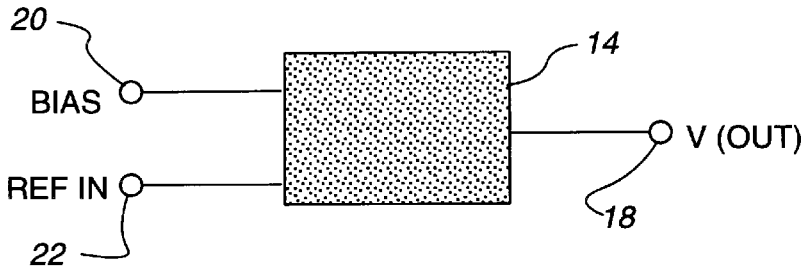
FIG. 2 is a diagram of the first embodiment of the boost circuit of FIG. 1 shown as a stand-alone circuit block.
Figure 3:
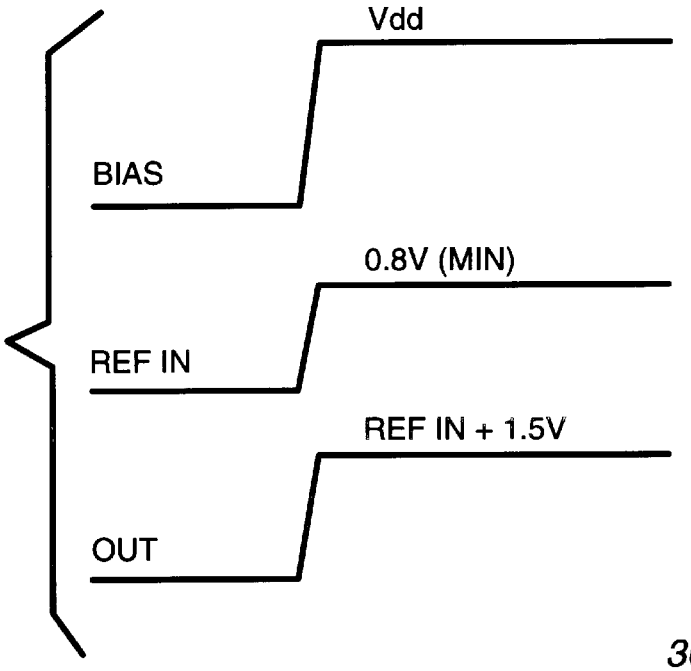
FIG. 3 is a timing diagram showing the signals associated with the boost circuit of FIGS. 1 and 2.

Referring now to FIG. 2, boost circuit 14 can be used as a stand-alone circuit block, as long as the proper BIAS and REFIN signals are provided at nodes 20 and 22, respectively. These signals are best seen in FIG. 3. The BIAS control signal is a pulse or step input signal having a pulse or step height that is roughly equal to the VDD power supply voltage. A nominal power supply voltage is typically five volts, 3.3 volts, or three volts. Boost circuit 14, however, is designed to provide a boosted voltage at the output node 18 for VDD supply voltages as low as 1.8 volts. The REFIN voltage input signal at node 22 is a pulse or step signal having a pulse or step height greater than or equal to about 0.8 volts. Voltages less than 0.8 volts are not recommended since this is the minimum voltage needed to energize transistor M8. It will be appreciated by those skilled in the art, however, that certain semiconductor processes may allow for lower threshold voltages, with consequently lower REFIN voltages. The OUT signal at node 18 is shown in FIG. 3 as a pulse or step signal having a pulse height equal to the REFIN signal height plus a nominal boost voltage of approximately 1.5 volts. Boost circuit 14 is turned off when the BIAS and REFIN signals are low, which also forces the OUT signal low. The operation of boost circuit 14 is described in further detail below.

The operation of boost circuit 14 is described referring generally to FIGS. 1–3, and in conjunction generator circuit 12, at a typical supply voltage equal to three volts. When the input signal at node 16, designated IN, is high (equal to VDD), transistor M4 turns on supplying zero volts to the REFIN node 22. Since P-channel transistors M2 and M5 do not have their sources tied to VDD, there is a non-zero source-to-substrate voltage associated with these devices. As a result, nodes 20 and 24 have a voltage equal to $-V_T$, the negative of the threshold voltage for a P-channel transistor, which is approximately one volt. Transistor M6 is used to isolate the voltage on node 24 from the output node 18, OUT, so that no voltage is transferred to the output.

When the IN input signal at node 16 goes low (zero volts), transistor M1 turns on, followed by transistor M2, which supplies a positive voltage to REFIN node 22. Transistor M3 then begins to sink current due to the feedback loop. Consequently, both transistors M2 and M3 are in saturation competing with each other and, as a result, supply approximately 0.9V at REFIN node 22. The BIAS node 20 raises to just below VDD due to the non-zero source-to-substrate voltage on P-channel transistor M2. Furthermore, as the REFIN signal at node 22 changes from zero volts to about 0.9 volts, transistors M8 and M5 start to conduct. This raises the output node 18, turning on transistor M6 and generating a feedback loop, which helps to pull down the output voltage at node 18. At this point, transistors M6 and M8 are competing with each other to obtain the appropriate voltage on OUT node 18, which is approximately 1.5V higher than the REFIN signal at node 22.

To return to the initial conditions, the input signal IN at node 16 goes high for a second time, and the BIAS voltage at node 20 drops back to $-V_T$. The REFIN node 22 is grounded via transistor M4 turning on, which turns off transistors M5, M6 and M8. Consequently, the voltage trapped on the SAT node 24 is coupled into the gate of transistor M7, pulling the output node 18 to ground.

Simulations show that boost circuit 14 functions properly at a minimum VDD power supply voltage of about 1.8 volts to a maximum VDD power supply voltage of about five volts, or even higher if desired for a particular application.

Figure 4:
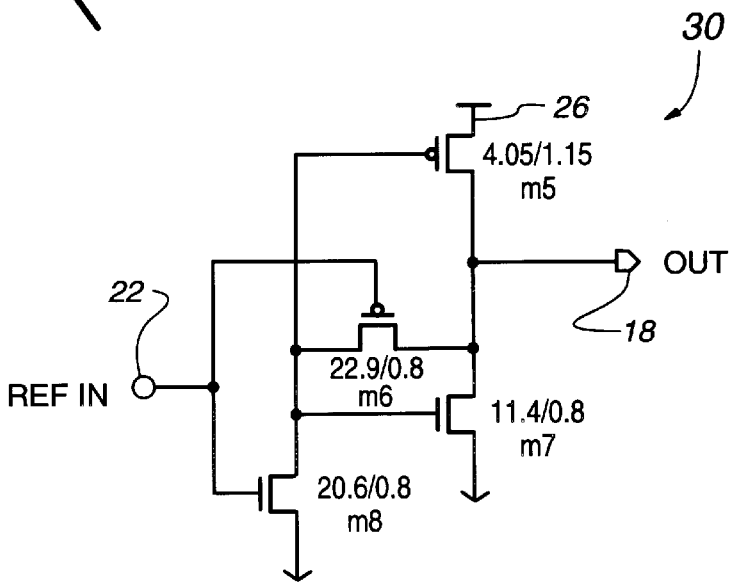
FIG. 4 is a schematic diagram of a second embodiment of a boost circuit according to the present invention.

Referring now to FIG. 4, a second embodiment 30 of the boost circuit is shown in which the source of transistor M5 is coupled directly to the VDD power supply voltage. In this embodiment, boost circuit 30 has a single REFIN input 22 and a single OUT output node 18. Boost circuit 30 is desirably used to translate a single input DC voltage into a boosted output voltage at node 18. Note again, that the REFIN input voltage is ideally greater than or equal to 0.8 volts.

Figure 5:
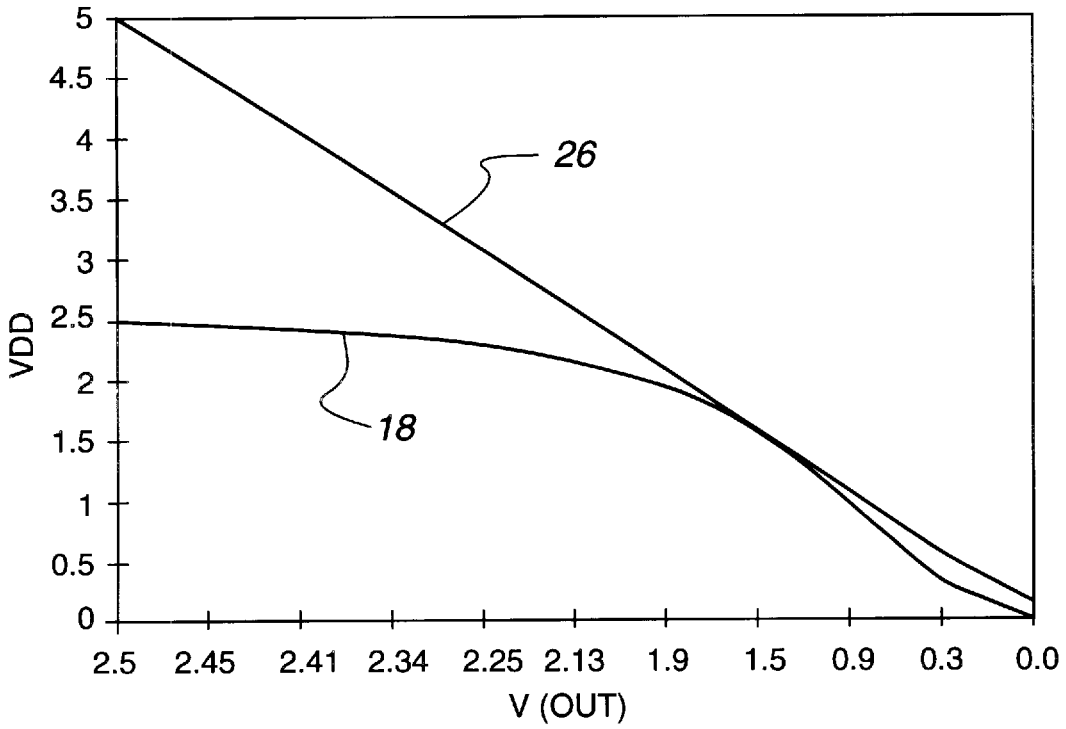
FIG. 5 is a plot of the output voltage of the boost circuit of FIG. 4 as a function of power supply voltage.

Referring now to FIG. 5, a DC—DC simulation plot shows the boosted voltage at node 18 as a function of the VDD supply voltage 26 plotted from zero to five volts, for a REFIN DC input voltage of about 0.8 volts. The curve labeled 18 represents the output voltage of boost circuit 30, and the curve labeled 26 represents the VDD supply voltage decreasing from five volts to zero volts. Note that the nominal output voltage of boost circuit 30 is about 2.5 volts, and decreases slightly until a VDD power supply voltage of about two volts is reached. A boosted voltage is still possible down to a power supply voltage of about 1.8 volts, or even lower. Eventually the boost function becomes inoperable for extremely low power supply voltages, wherein the output voltage at node 18 essentially tracks the VDD power supply voltage.

In FIG. 4, the transistor type, size, and circuit topology are the same as for the boost circuit 14 shown in FIG. 1. The sole exception is that the source ofP-channel transistor M5 is coupled directly to a source 26 of the VDD power supply voltage, thus eliminating the BIAS control signal and input shown in the boost circuit 14 of FIG. 1.

Figure 6:
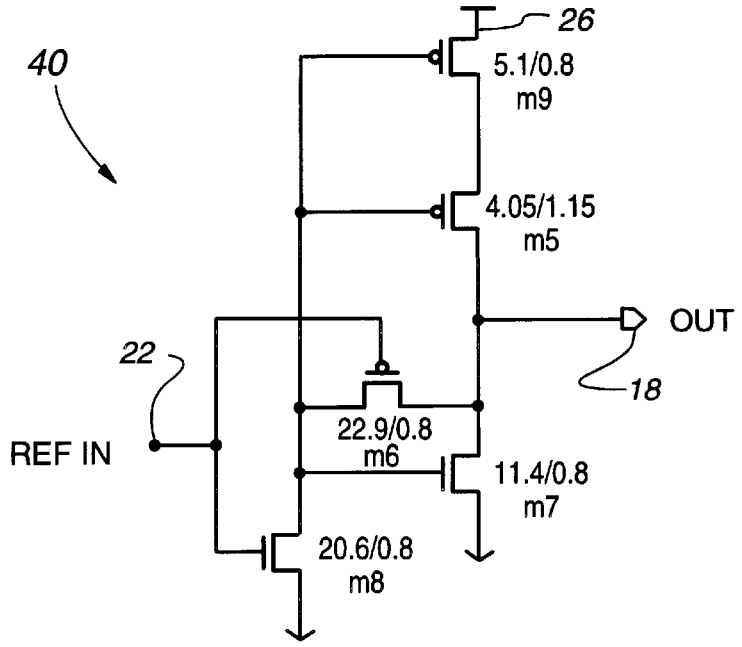
FIG. 6 is a schematic diagram of a third embodiment of a boost circuit according to the present invention.

A third embodiment of the present invention is shown in schematic form in FIG. 6. Boost circuit 40 is a switchable boost circuit having a single input that can be used with stepped or pulse REFIN signals at node 22. Boost circuit 40, however, has a drawback in that the circuit continuously draws current regardless of the level of the REFIN voltage at node 22. The extra power consumption may limit the applications suitable for boost circuit 40. For three volt VDD operation, the source current is approximately 30 $\mu$A when REFIN is at zero volts and 40 $\mu$A when REFIN is one volt. As the reference voltage is increased, the magnitude of the source current peaks at a reference voltage of about 1.5 volts, and then decreases. It is appreciated by those skilled in the art that the exact value of this source current will change somewhat with differences in semiconductor processing.

Figure 7:
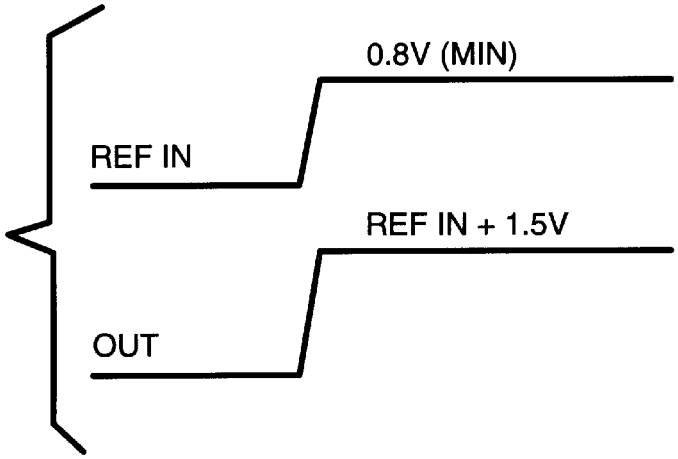
FIG. 7 is a timing diagram showing the signals associated with the boost circuit of FIG. 6.

The boost circuit 40 shown in FIG. 6 has an extra P-channel transistor, M9, which forces the output node 18, designated OUT, low when the input signal REFIN is low. The size of transistor M9 is about 5.1 by 0.8 microns. The gates of transistors M5 and M9 are coupled together and the current paths of transistors M5 and M9 are coupled in series between the power supply voltage at node 26 and the output node 18. Otherwise, the remaining circuit topology, transistor types and sizes are the same as for boost circuit 30 shown in FIG. 4. The step REFIN and OUT waveforms associated with boost circuit 40 are shown in FIG. 7.

Having described and illustrated the principle of the invention in a preferred embodiment thereof, it is appreciated by those having skill in the art that the invention can be modified in arrangement and detail without departing from such principles. For example, while the sizes of the transistors have been specified in detail, other sizes can be used as required to accommodate other semiconductor processes and layout spacings. I therefore claim all modifications and variations coming within the spirit and scope of the following claims.

I claim:

1. A voltage boost circuit comprising:

a first input for receiving a voltage input signal;

a second input for receiving a control signal;

an output for providing a boosted input signal;

a first transistor having a control node, and a current path coupled between the second input and the output;

a second transistor having a control node coupled to the first input, and a current path coupled between the control node of the first transistor and the output;

a third transistor having a control node coupled to the control node of the first transistor, and a current path coupled between the output and ground; and a fourth transistor having a control node coupled to the first input and a current path coupled between the control node of the first transistor and ground.

2. A boost circuit as in claim 1 in which each of the first and second transistors comprise a P-channel MOS transistor.

3. A boost circuit as in claim 1 in which each of the third and fourth transistors comprise an N-channel MOS transistor.

4. A boost circuit as in claim 1 in which the size of the second and fourth transistors is substantially equal.

5. A boost circuit as in claim 1 in which the control signal comprises a pulse or step signal having a pulse or step height substantially equal to a power supply voltage.

6. A boost circuit as in claim 5 in which the power supply voltage level for providing a boosted output voltage is at least 1.8 volts.

7. A boost circuit as in claim 1 in which the voltage input signal comprises a pulse or step signal having a pulse or step height greater than or equal to about 0.8 volts.

8. A voltage boost circuit comprising:

an input for receiving a voltage input signal;

an output for providing a boosted input signal;

a first transistor having a control node, and a current path coupled between a source of power supply voltage and the output;

a second transistor having a control node coupled to the input, and a current path coupled between the control node of the first transistor and the output;

a third transistor having a control node coupled to the control node of the first transistor, and a current path coupled between the output and ground; and a fourth transistor having a control node coupled to the input and a current path coupled between the control node of the first transistor and ground.

9. A boost circuit as in claim 8 in which each of the first and second transistors comprise a P-channel MOS transistor.

10. A boost circuit as in claim 8 in which each of the third and fourth transistors comprise an N-channel MOS transistor.

11. A boost circuit as in claim 8 in which the size of the second and fourth transistors is substantially equal.

12. A boost circuit as in claim 8 in which the power supply voltage capable of providing a boosted output voltage is at least 1.8 volts.

13. A boost circuit as in claim 8 in which the voltage input signal is greater than or equal to about 0.8 volts.

14. A voltage boost circuit comprising:

an input for receiving a voltage input signal;

an output for providing a boosted input signal;

a first transistor having a control node and a current path;

a second transistor having a control node and a current path, wherein the control nodes of the first and second transistors are coupled together, and the current paths of the first and second transistors are coupled in series between the output and a source of supply voltage;

a third transistor having a control node coupled to the input, and a current path coupled between the control node of the first transistor and the output;

a fourth transistor having a control node coupled to the control node of the first transistor, and a current path coupled between the output and ground; and a fifth transistor having a control node coupled to the input and a current path coupled between the control node of the first transistor and ground.

15. A boost circuit as in claim 14 in which each of the first, second, and third transistors comprise a P-channel MOS transistor.

16. A boost circuit as in claim 14 in which each of the fourth and fifth transistors comprise an N-channel MOS transistor.

17. A boost circuit as in claim 14 in which the size of the third and fifth transistors is substantially equal.

18. A boost circuit as in claim 14 in which the size of the third transistor is about 22.9 by about 0.8 microns and the size of the fifth transistor is about 20.6 by about 0.8 microns.

19. A boost circuit as in claim 14 in which the power supply voltage capable of providing a boosted output voltage is at least 1.8 volts.

20. A boost circuit as in claim 14 in which the voltage input signal has a step or pulse height of greater than or equal to about 0.8 volts.

* * * * *